US009460830B2

(12) United States Patent
Mekala et al.

(10) Patent No.: US 9,460,830 B2
(45) Date of Patent: Oct. 4, 2016

(54) PARTICLE LOADED, FIBER-REINFORCED COMPOSITE MATERIALS

(71) Applicant: 3M INNOVATIVE PROPERTIES COMPANY, St. Paul, MN (US)

(72) Inventors: David Robert Mekala, Maplewood, MN (US); Mark A. Wright, Hudson, WI (US); Jung-Sheng Wu, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 14/651,391

(22) PCT Filed: Dec. 12, 2013

(86) PCT No.: PCT/US2013/074525

§ 371 (c)(1),
(2) Date: Jun. 11, 2015

(87) PCT Pub. No.: WO2014/099564

PCT Pub. Date: Jun. 26, 2014

(65) Prior Publication Data

US 2015/0318080 A1 Nov. 5, 2015

Related U.S. Application Data

(60) Provisional application No. 61/739,929, filed on Dec. 20, 2012.

(51) Int. Cl.
*H01B 7/00* (2006.01)
*H01B 5/08* (2006.01)

(Continued)

(52) U.S. Cl.
CPC *H01B 5/08* (2013.01); *H01B 1/02* (2013.01); *H01B 3/47* (2013.01); *Y10T 428/2927* (2015.01); *Y10T 428/2958* (2015.01)

(58) Field of Classification Search
USPC ..... 174/110 R–110 N, 113 R, 120 R, 121 R, 174/120 SR
See application file for complete search history.

(56) References Cited

U.S. PATENT DOCUMENTS 3,245,425 A * 4/1966 De Meyer ..... F15B 5/003 137/414
4,649,060 A 3/1987 Ishikawa
4,779,563 A 10/1988 Ishikawa (Continued)

FOREIGN PATENT DOCUMENTS

CN 1986868 6/2007
JP H11-326718 11/1999

(Continued)

OTHER PUBLICATIONS

Asano, "Effects of Particle-Dispersion on the Strength of an Alumina Fiber-Reinforced Aluminum Alloy Matrix Composite", Materials Transactions, 2003, vol. 44, No. 6, pp. 1172-1180.

(Continued)

*Primary Examiner* — William H Mayo, III
(74) *Attorney, Agent, or Firm* — Adam Bramwell

(57) ABSTRACT

A composite material includes a plurality of fibers embedded in a metal matrix. The composite material further includes a plurality of particles disposed in the metal matrix. At least 25% of the fibers contact or are spaced less than 0.2 micrometers from an adjacent fiber within the metal matrix.

20 Claims, 3 Drawing Sheets

(51) Int. Cl.
*H01B 1/02* (2006.01)
*H01B 3/47* (2006.01)

(56) References Cited

U.S. PATENT DOCUMENTS

| | | | | |
|---|---|---|---|---|
| 4,877,643 | A | 10/1989 | Ishikawa | |
| 4,951,990 | A | 8/1990 | Hollan | |
| 4,961,990 | A | 10/1990 | Yamada | |
| 5,068,142 | A | 11/1991 | Nose | |
| 5,126,167 | A | 6/1992 | Matsuno | |
| 5,171,942 | A | 12/1992 | Powers | |
| 5,554,826 | A | 9/1996 | Gentry | |
| 5,933,703 | A | 8/1999 | Robertson | |
| 6,175,677 | B1 | 1/2001 | Yang | |
| 6,245,425 | B1 | 6/2001 | McCullough | |
| 6,544,645 | B1 * | 4/2003 | McCullough | C22C 47/025 428/357 |
| 7,060,326 | B2 | 6/2006 | Hiel | |
| 7,093,415 | B2 | 8/2006 | Kallevig | |
| 7,093,426 | B2 | 8/2006 | Ichihara | |
| 7,179,522 | B2 | 2/2007 | Hiel | |
| 7,297,238 | B2 | 11/2007 | Nayar | |
| 7,438,971 | B2 | 10/2008 | Bryant | |
| 7,683,262 | B2 | 3/2010 | Guery | |
| 2004/0018352 | A1 | 1/2004 | Evans | |
| 2011/0174519 | A1 | 7/2011 | Shah | |
| 2012/0163758 | A1 * | 6/2012 | McCullough | H01B 7/14 385/101 |
| 2012/0168199 | A1 * | 7/2012 | McCullough | H01B 7/14 174/113 R |

FOREIGN PATENT DOCUMENTS

| | | |
|---|---|---|
| WO | WO 97-00976 | 1/1997 |
| WO | WO 2012-037265 | 3/2012 |

OTHER PUBLICATIONS

Asano, "Effects of Particle-Dispersion on the Tensile Properties of a Continuous Alumina Fiber-Reinforced Aluminum Alloy Matrix Composite", Journal of Japan Institute of Metals and Materials, 2004, vol. 68, No. 8, pp. 582-590.

Hu, "The Mechanical Properties of Al Alloys Reinforced with Continuous Al2O3 Fibers", Acta Metallurgica et Materialia, 1992, vol. 40, No. 9, pp. 2315-2326.

McLean, "SiC particulate-reinforced, aluminium-matrix composite rods and wires produced by a new continuous casting route", Composites Part A, 1997, vol. 28A, pp. 153-162.

Mizumoto, "Characterization of fiber-reinforced metal matrix composites fabricated by low-pressure infiltration process", Materials Science and Engineering A, 2005, vol. 413-414, pp. 521-526.

Sorenson, "Aluminum Matrix Composite Component Development—1998", 3M Technical Report, 1998, 5 Pgs.

Yamada, "Mechanical Properties of Aluminum Alloys Reinforced with Continuous Fibers and Dispersoids", Cast Reinforced Metal Composites, 1988, pp. 109-114.

International Search Report for PCT International Application No. PCT/US2013/074525, Apr. 4, 2014, 4 pages.

S.C. Tjong, "Novel Nanoparticle-Reinforced Metal Matrix Composites with Enhanced Mechanical Properties," Advanced Engineering Materials, vol. 9, No. 8, Aug. 1, 2007 (14 pages).

European Search Report for EP 13 86 5792, dated Aug. 1, 2008, 9 pages.

* cited by examiner

PARTICLE LOADED, FIBER-REINFORCED COMPOSITE MATERIALS

CROSS REFERENCE TO RELATED APPLICATIONS

This application is a national stage filing under 35 U.S.C. 371 of PCT/US2013/074525, filed Dec. 12, 2013, which claims priority to U.S. Provisional Application No. 61/739,929, filed Dec. 20, 2012, the disclosure of which is incorporated by reference in its/their entirety herein.

TECHNICAL FIELD

The present disclosure relates to composite materials including reinforcing fibers and particles, wires made using such composite materials, cables made using such composite wires, and methods of making and using such composite wires and cables.

BACKGROUND

Metal matrix composites have long been recognized as promising materials due to their combination of high strength and stiffness combined with low weight. Metal matrix composites typically include a metal matrix reinforced with fibers. Examples of metal matrix composites include aluminum matrix composite wires (e.g., silicon carbide, carbon, boron, or polycrystalline alpha alumina fibers in an aluminum matrix), titanium matrix composite tapes (e.g., silicon carbide fibers in a titanium matrix), and copper matrix composite tapes (e.g., silicon carbide fibers in a copper matrix).

The use of some metal matrix composite wires as a reinforcing member in overhead electrical power transmission cables is of interest. The need for new materials in such cables is driven by the need to increase the power transfer capacity of existing transmission infrastructure due to load growth and changes in power flow.

SUMMARY

In some embodiments, a composite material is provided. The composite material includes a plurality of fibers embedded in a metal matrix, and a plurality of particles disposed in the metal matrix. At least 25% of the fibers contact or are spaced less than 0.2 micrometers from an adjacent fiber within the metal matrix.

In some embodiments, a composite wire is provided. The composite wire includes a plurality of substantially continuous fibers embedded in a metal matrix, the plurality of substantially continuous fibers and metal matrix forming a substantially continuous composite wire. The composite wire further includes a plurality of particles disposed in the metal matrix. The plurality of particles are present at less than 0.1 wt. % based upon the total dry fiber weight of the substantially continuous fibers. The plurality of particles have a mean diameter of no greater than 100 nanometers.

In some embodiments, a method for making a composite material is provided. The method includes impregnating a plurality of particle-loaded fibers with a metal matrix, and solidifying the metal matrix. Following the step of solidifying, at least 25% of the fibers contact or are spaced less than 0.2 micrometers from an adjacent fiber within the metal matrix.

Various aspects and advantages of exemplary embodiments of the disclosure have been summarized. The above Summary is not intended to describe each illustrated embodiment or every implementation of the present certain exemplary embodiments of the present disclosure. The Drawings and the Detailed Description that follow more particularly exemplify certain embodiments using the principles disclosed herein.

BRIEF DESCRIPTION OF THE DRAWINGS

Like reference numerals in the drawings indicate like elements. The drawings herein are not drawn to scale, and in the drawings, the components of the composite wires and cables may be sized to emphasize selected features.

DETAILED DESCRIPTION

Figure 1:
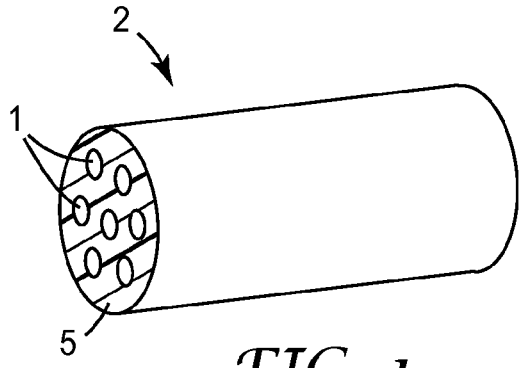
FIG. 1 is a perspective view of a composite wire in accordance with some embodiments of the present disclosure.

Various composite materials such as fiber-reinforced metals, polymers, or ceramics are known for use as various structural members or parts. It is further known that the strength of such fiber-reinforced composite materials may be further improved by infiltrating the reinforcing fibers with small particles, whiskers, and/or short or chopped fibers, typically, of inorganic material. Such bodies, typically on the order of less than 20 micrometers, become trapped at the fiber surface and provide for spacing between individual fibers within the composite. It is believed that the spacing eliminates interfiber contact and thereby yields a stronger composite. A discussion of the use of small bodies of material to minimize interfiber contact can be found in U.S. Pat. No. 4,961,990 (Yamada et al). Such bodies are often present in the composite at 10 wt. % or greater based upon total composite matrix weight. For example, Asano, K., and Yoneda, H., "Effects of particle-dispersion on strength of an Alumina fiber re-inforced Aluminum Alloy Matrix Composite", *Materials Transactions*, Vol. 44, No. 6, pp 1172-1180 (2003), employed alumina particle loadings of about 10% by weight based upon total composite matrix weight in their alumina fiber-reinforced aluminum matrix composite to obtain a tensile strength increase of approximately 12% in the temperature range of 27° C.-350° C. As another example, Yamada, S., Towata, S. Ikuma, H, "Mechanical properties of aluminum alloys re-inforced with continuous fibers and dispersoids", Cast Re-inforced Metal Composites, edited by S G. Fishman and A K Dhinsara, pp 109-114, (1992), discusses fiber reinforced metal composites having particulates at greater than 10% by weight based on the total composite matrix.

Accordingly, conventional wisdom in the art suggests that elimination of interfiber contact through the addition of small bodies is necessary to yield a stronger composite, and that such bodies should be present in the composite at greater than about 10 wt. %. Contrary to this general understanding, the present inventors have discovered that a surprising and significant increase in tensile strength of a fiber-reinforced metal matrix composite wire can be achieved by adding ultra-small amounts (e.g., less than 1%, less than 0.1%, or even less than 0.05%) of nanoparticles (e.g., mean diameter of less than 250 nm, less than 100 nm, or even less than 75 nm) to the surfaces of the fibers, and that in such particle-strengthened composite wires, interfiber contact substantially remains.

Typically, in the manufacture of particle loaded, fiber-reinforced metal matrix wires, the particles are deposited onto bundles, or tows of the reinforcing fibers. Next, the particle coated tows are passed through a reservoir of molten metal where the molten metal infiltrates the particle-coated tows. The tows and the infiltrate metal then pass through a die attached to the exit of the reservoir. The size of the exit die dictates the diameter and shape of the resulting fiber reinforced metal matrix wires. Generally, the tows occupy approximately 50-60% of the volume of the extruding exit die. A common obstacle associated with the manufacture of such composite wire is die plugging due to the tightness of the tows in the exit die. The occurrence of die plugs significantly lowers the yields of the manufacture process, thereby significantly increasing the manufacturing costs. It has been observed that the addition of particles to the composite wires, while increasing the strength of the wire, exacerbates the problem of die plugging. Therefore, particle loaded, fiber-reinforced composite wire compositions that maintain the strength increases associated with known compositions, but facilitate a reduction in the occurrence of die plugs during manufacture may be particularly advantageous.

In this regard, the present inventors have surprisingly and unexpectedly discovered by proper selection of the loading and size of the particles, tensile strength increases of the fiber-reinforced metal matrix composite wires can be achieved without increasing the frequency of die plugs during manufacture.

Glossary

Certain terms are used throughout the description and the claims that, while for the most part are well known, may require some explanation. It should understood that, as used throughout this application:

The term "nanoparticles" means a particle (or plurality of particles) having a mean diameter of one micrometer (1,000 nm) or less, more preferably 900 nm or less, even more preferably 800 nm or less, 750 nm or less, 700 nm or less, 600 nm or less, 500 nm or less, 400 nm or less, 300 nm or less, 250 nm or less, 200 nm or less, 150 nm or less, 100 nm or less, 75 nm or less, or even 50 nm or less.

The term "ceramic" means glass, crystalline ceramic, glass-ceramic, and combinations thereof.

The term "polycrystalline" means a material having predominantly a plurality of crystalline grains in which the grain size is less than the diameter of the fiber in which the grains are present.

The term "bend" or "bending" when used to refer to the deformation of a wire includes two dimensional and/or three dimensional bend deformation, such as helically bending the wire during stranding. When referring to a wire as having bend deformation, this does not exclude the possibility that the wire also has deformation resulting from tensile and/or torsional forces.

The term "ductile" when used to refer to the deformation of a wire, means that the wire would substantially undergo plastic deformation during bending or under tensile loading without fracture or breakage.

The term "brittle" when used to refer to the deformation of a wire, means that the wire will fracture during bending or under tensile loading with minimal plastic deformation.

The term "wire" refers to an elongated member or strand of elongated members having a length at least 5 times, at least 10 times, or even at least 100 times that of its cross section.

The term "composite wire" refers to a wire formed from a combination of materials differing in composition or form which are bound together.

The term "metal matrix composite wire" refers to a composite wire comprising one or more reinforcing fiber materials bound into a matrix including one or more metal phases, and which exhibit non-ductile behavior and are brittle.

The terms "cabling" and "stranding" are used interchangeably, as are "cabled" and "stranded."

The term "lay" describes the manner in which the wires in a stranded layer of a helically stranded cable are wound into a helix.

The term "lay direction" refers to the stranding direction of the wire strands in a helically stranded layer. To determine the lay direction of a helically stranded layer, a viewer looks at the surface of the helically stranded wire layer as the cable points away from the viewer. If the wire strands appear to turn in a clockwise direction as the strands progress away from the viewer, then the cable is referred to as having a "right hand lay." If the wire strands appear to turn in a counter-clockwise direction as the strands progress away from the viewer, then the cable is referred to as having a "left hand lay."

The terms "center axis" and "center longitudinal axis" are used interchangeably to denote a common longitudinal axis positioned radially at the center of a multilayer helically stranded cable.

The term "lay angle" refers to the angle, formed by a helically stranded wire, relative to the center longitudinal axis of a helically stranded cable.

The term "crossing angle" means the relative (absolute) difference between the lay angles of adjacent wire layers of a helically stranded wire cable.

The term "lay length" refers to the length of a helically stranded cable in which a single wire in a helically stranded layer completes one full helical revolution about the center longitudinal axis of a helically stranded cable.

The term "continuous fiber" means a fiber having a length that is relatively infinite when compared to the average fiber diameter. Typically, this means that the fiber has an aspect ratio (i.e., ratio of the length of the fiber to the average diameter of the fiber) of at least $1\times10^5$ (in some embodiments, at least $1\times10^6$, or even at least $1\times10^7$). Typically, such fibers have a length on the order of at least about 15 cm to at least several meters, and may even have lengths on the order of kilometers or more.

The term "diameter" refers to the longest dimension of the cross-sectional area of a structural member or body, it being understood that structural members may have shapes that are non-circular.

As used herein, the singular forms "a", "an", and "the" include plural referents unless the content clearly dictates otherwise. As used in this specification and the appended embodiments, the term "or" is generally employed in its sense including "and/or" unless the content clearly dictates otherwise.

As used herein, the recitation of numerical ranges by endpoints includes all numbers subsumed within that range (e.g. 1 to 5 includes 1, 1.5, 2, 2.75, 3, 3.8, 4, and 5).

Unless otherwise indicated, all numbers expressing quantities or ingredients, measurement of properties and so forth used in the specification and embodiments are to be understood as being modified in all instances by the term "about." Accordingly, unless indicated to the contrary, the numerical parameters set forth in the foregoing specification and attached listing of embodiments can vary depending upon the desired properties sought to be obtained by those skilled in the art utilizing the teachings of the present disclosure. At the very least, and not as an attempt to limit the application of the doctrine of equivalents to the scope of the claimed embodiments, each numerical parameter should at least be construed in light of the number of reported significant digits and by applying ordinary rounding techniques.

In some embodiments, the present disclosure describes a composite material comprising a plurality of fibers embedded in a matrix material, the composite material further comprising a plurality particles having a mean diameter of one micrometer or less (i.e., nanoparticles) disposed in the matrix. In some embodiments, the present disclosure describes a composite wire comprising a plurality of substantially continuous fibers embedded in a matrix material and forming a substantially continuous filament, the composite wire further comprising a plurality particles having a mean diameter of one micrometer or less disposed in the matrix. The plurality of substantially continuous fibers may be substantially parallel in a direction taken substantially parallel to a longitudinal axis of the composite wire. In illustrative embodiments, the fibers may further comprise a plurality of fiber surfaces (e.g., exterior surfaces), and the plurality of particles disposed in the matrix may contact or in be in close proximity to the plurality of fiber surfaces.

Referring now to the drawings, an exemplary composite wire 2 is illustrated in FIG. 1. As shown, a composite wire 2 may comprise fibers 1 and a matrix 5. While not illustrated, the composite wire 2 may further comprise a plurality of particles disposed in close proximity to or on the exterior surfaces of the fibers 1. Generally, the fibers 1 may be aligned in the length direction of the wire. In addition to the exemplary circular cross-section illustrated in FIG. 1 (i.e., a cylindrical cable), any known or desired cross-section may be produced by appropriate design of the wire forming die, as will be described further below.

In some embodiments, suitable matrix materials for use in the composite materials of the present disclosure may include one or more metals. For example, the metal matrix material may include aluminum, zinc, tin, magnesium, and alloys thereof (e.g., an alloy of aluminum and copper). In some embodiments, the matrix material may include aluminum and alloys thereof. For example, the metal matrix material may include at least 98 percent by weight aluminum, at least 99 percent by weight aluminum, greater than 99.9 percent by weight aluminum, or even greater than 99.95 percent by weight aluminum. Exemplary aluminum alloys of aluminum and copper include at least 98 percent by weight Al and up to 2 percent by weight Cu. In some embodiments, useful alloys are 1000, 2000, 3000, 4000, 5000, 6000, 7000 and/or 8000 series aluminum alloys (Aluminum Association designations). Generally, the matrix material may be selected such that the matrix material does not significantly chemically react with the fiber (i.e., is relatively chemically inert with respect to fiber material), for example, to eliminate the need to provide a protective coating on the fiber exterior. Suitable metals are commercially available. For example, aluminum is available under the trade designation "SUPER PURE ALUMINUM; 99.99% Al" from Alcoa of Pittsburgh, Pa., Aluminum alloys (e.g., Al-2% by weight Cu (0.03% by weight impurities)) can be obtained, for example, from Belmont Metals, New York, N.Y. Zinc and tin are available, for example, from Metal Services, St. Paul, Minn. ("pure zinc"; 99.999% purity and "pure tin"; 99.95% purity). As another example, magnesium is available under the trade designation "PURE" from Magnesium Elektron, Manchester, England. Magnesium alloys (e.g., WE43A, EZ33A, AZ81A, and ZE41A) and can be obtained, for example, from TIMET, Denver, Colo.

Alternatively, or additionally, the matrix material may include one or more polymers (e.g., epoxies, esters, vinyl esters, polyimides, polyesters, cyanate esters, phenolic resins, bismaleimide resins and thermoplastics).

In illustrative embodiments, the composite materials of the present disclosure may include one or more fibers (e.g., continuous fibers) embedded in a matrix as described above. Generally, any fibers suitable for use in fiber-reinforced composite materials may be used. In some embodiments, the one or more fibers may include metal, polymer, ceramic, glass, carbon, and combinations thereof. Exemplary fibers include carbon (e.g., graphite) fibers, glass fibers, ceramic fibers, silicon carbide fibers, polyimide fibers, polyamide fibers, or polyethylene fibers. In other embodiments, the fibers may comprise titanium, tungsten, boron, shape memory alloy, graphite, silicon carbide, boron, aramid, poly(p-phenylene-2,6-benzobisoxazole), and combinations thereof. Combinations of materials or fibers may also be used. Generally, the form of the fibers is not particularly limited. Exemplary fiber forms include unidirectional arrays of individual continuous fibers, yarn, roving, and braided constructions. Woven and non-woven mats may also be included.

In various embodiments, the fibers may include alumina fibers. The alumina fibers may be polycrystalline alpha alumina-based fibers and comprise, on a theoretical oxide basis, greater than 99 percent by weight $Al_2O_3$ and 0.2-0.5 percent by weight $SiO_2$, based on the total weight of the alumina fibers. In another aspect, polycrystalline, alpha alumina-based fibers may comprise alpha alumina having an average grain size of less than 1 micrometer. Suitable commercially available alumina fibers include, for example, alpha alumina fibers available under the trade designation "NEXTEL 610" from the 3M Company of St. Paul, Minn.

In illustrative embodiments, the reinforcing fibers may have an average diameter of at least 5-15 micrometers. The diameter of the fibers may be no greater than 50 micrometers, or no greater than 25 micrometers. As used herein with respect to the reinforcing fibers, the term "diameter" refers to the longest dimension of the cross-sectional area of the fiber, it being understood that the fibers may have shapes without a circular cross section.

In some embodiments, the composite materials may include at least 15 percent by volume (in some embodiments, at least 20, 25, 30, 35, 40, 45, 50, 55, 60 or even 65 percent by volume) of the fibers, based on the total combined volume of the fibers and matrix material. In further embodiments, the composite wires may include in the range from 40 to 75 (in some embodiments, 45 to 70) percent by volume of the fibers, based on the total combined volume of the fibers and matrix material. In some embodiments, at least 85% (in some embodiments, at least 90%, or even at least 95%) by number of the fibers in the composite wires are continuous.

In some embodiments, the composite materials may further include a plurality of particles (e.g., nanoparticles). Generally, the plurality of particles may be disposed in close proximity to or on the exterior surfaces of the fibers. For example, in certain embodiments, at least 80%, at least 90%, at least 95%, or even at least 99% of the particles may contact or be in close proximity (e.g., less than 100 nm, or less than 50 nm) to the exterior surfaces of the fibers. While the present application discusses only particles as composite material strengthening bodies, it is to be appreciated that that other small bodies such as short/chopped fibers, platelets, or needles may also, or alternatively, be employed.

In illustrative embodiments, the plurality of particles may comprise one or more metal oxides. Any known metal oxide may be used. Exemplary metal oxides include silica, titania, alumina, zirconia, vanadia, chromia, antimony oxide, tin oxide, zinc oxide, ceria, and mixtures thereof. In some embodiments, the plurality of nanoparticles comprises a non-metal oxide such as silicon carbide or surface treated oxide powders.

In various embodiments, the quantity of particles disposed in the composite material ("particle loading") may be ultra-low relative to conventional fiber-reinforced composite materials having small domains (e.g., particles, whiskers, short, and/or chopped fibers) disposed therein. For purposes of the present disclosure, particle loading of a composite material may be described in terms of the weight percentage of the particles disposed in the composite material based on the total dry weight of the fibers in the composite material. In some embodiments, the particle loading of the composite materials may be less than 5 wt. %, less than 1 wt. %, less than 0.5 wt. %, less than 0.1 wt. %, or even less than 0.05 wt. % based on the total dry weight of the fibers.

In illustrative embodiments, the plurality of particles may have a mean diameter no greater than 1000 nm, 900 nm, 800 nm, 750 nm, 700 nm, 600 nm 500 nm, 400 nm, 300 nm, 250 nm, 200 nm, 150 nm, 100 nm, 50 nm or even no greater than 30 nm. The plurality of particles may range in size from 10 nm-5000 nm, 20 nm-500 nm, 20 nm-100 nm, or 20 nm-50 nm. The present inventors discovered that by employing relatively small nanoparticles (e.g., particles ranging from 10 nm-100 nm or from 20 nm-50 nm), adequate particle coverage of the fiber surfaces may be achieved without requiring high particle loading. That is, the present inventors discovered that by employing relatively small nanoparticles, even at very low particle loadings (e.g., less than 1 wt %, less, than 0.1 wt %, or even less than 0.05 wt %), particle coverage of the fiber surfaces comparable to that achieved with much higher loadings (e.g., 10 wt % or greater) of conventionally sized particles (e.g., 300 nm-2000 nm) could be achieved. In some embodiments, the composite matrix may further comprise a plurality of filler particles having a median diameter of at least 1 micrometer.

In some embodiments, the particles may be selected to achieve a distribution having a single mode. Alternatively, the particles may be selected to achieve a multimodal particle size distribution. Generally, a multimodal distribution is distribution having two or more modes, i.e., a bimodal distribution exhibits two modes, while a trimodal distribution exhibits three modes.

In some embodiments, the particles may be generally ellipsoidal or spheroidal (that is, particles having external surfaces that are rounded and free of sharp corners or edges, including truly or substantially circular or elliptical shapes and any other rounded or curved shapes.) Alternatively, the particles may be irregularly shaped. In some embodiments, the particles may be substantially symmetric particles. As used herein, "substantially symmetric particles" may refer to particles that are relatively symmetric in that the length, width, and height measurements are substantially the same and the average aspect ratio of such particles is less than or equal to 2.0, less than or equal to 1.5, less than or equal to 1.25, or 1.0.

In various embodiments, the particle-loaded composite wires of the present disclosure, despite their ultra-low particle loading, may have an average tensile strength that is significantly greater than corresponding composite wires (i.e., same size, materials, fiber-loading, etc.) having no particles dispersed therein. For example, the particle loaded composite wires of the present disclosure may exhibit at least a 2%, at least a 5%, or even at least a 9% tensile strength increase relative to corresponding composite wires having no particles dispersed therein. The particle-loaded composite wires of the present disclosure may have an average tensile strength of at least 250 MPa, at least 350 MPa, at least 1200 MPa, or even at least 1330 MPa.

In some embodiments, as a consequence of the ultra-low loading and diminutive size of the particles disposed in the composite materials, the spacing of the fibers in the composite materials of the present disclosure may be significantly reduced relative to known particle loaded, fiber reinforced composite materials. In this regard, at least 25%, at least 35%, at least 45%, at least 55%, at least 65%, at least 75%, at least 85%, or even at least 90% of the fibers embedded in the matrix material may contact (i.e., touch) or substantially contact (i.e., be spaced less than 0.2 micrometers from) an adjacent fiber within the metal matrix. As previously discussed, conventional wisdom in the art suggested that a significant reduction or elimination of interfiber contact was necessary achieve tensile strength increases. However, surprisingly and unexpectedly, the present inventors discovered that a significant increase in tensile strength of a particle loaded, fiber-reinforced composite material could be achieved despite the presence of substantial interfiber contact within the composite material.

In various embodiments in which the composite materials are in the form of a wire, the wires may have diameter ranging from 0.5 mm to 15 mm. The diameter of the composite wires may range from 1 mm to 12 mm, 1 mm to 10 mm, 1 to 8 mm, or even 1 mm to 4 mm. In some embodiments, the diameter of the composite wires may be at least 1 mm, at least 1.5 mm, 2 mm, 3 mm, 4 mm, 5 mm, 6 mm, 7 mm, 8 mm, 9 mm, 10 mm, 11 mm, or even at least 12 mm.

Figure 2A:
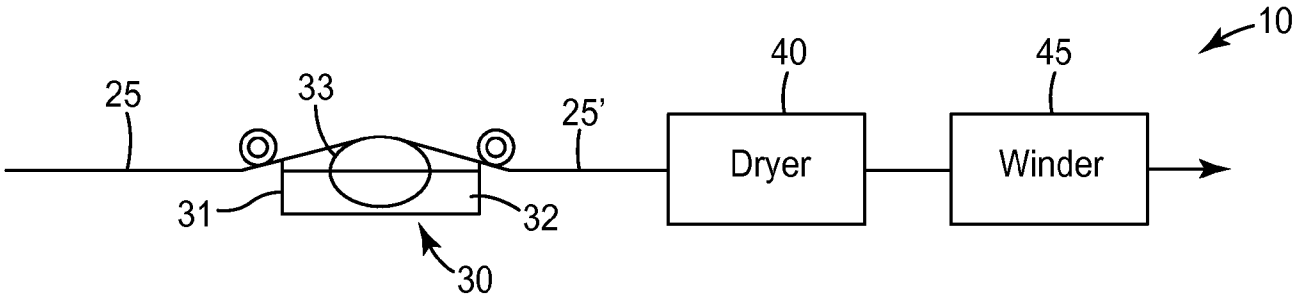
FIGS. 2A and 2B illustrate processes useful in forming particle coated fibers and fiber-reinforced composite wires, respectively, according to some embodiments of the present disclosure.
Figure 2B:
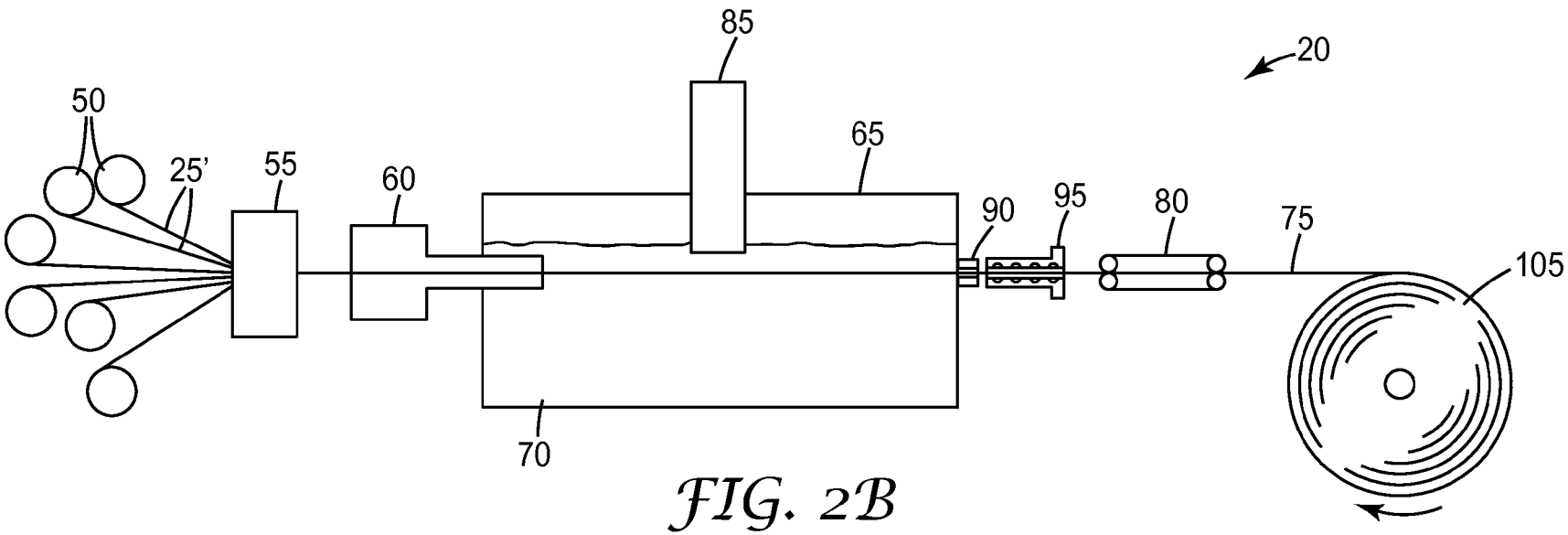

The present disclosure further relates to methods of making the above-described composite materials. A schematic of a system for making composite material in the form of a wire in accordance with some embodiments of the present disclosure is shown in FIGS. 2A and 2B. Generally, the system may be described as including a fiber coating process 10 (FIG. 2A) and a matrix infiltration/wire forming process 20 (FIG. 2B). As shown, in the fiber coating process 10, a tow 25 of continuous or substantially continuous fibers (or an individual continuous or substantially continuous fiber) may be supplied to a coating station 30 for depositing particles on an external surface of the fibers of the tow 25. The coated fiber tow 25' may then be transported through a dryer 40 and optionally a winder 45, before being transported to the matrix infiltration process 20.

Generally, the coating station 30 may include any device or operation suitable for depositing particles on the external surface of the fibers of the tow 25. For example, the coating station 30 may include or employ electrodeposition, blowing, a fluidized bed, and/or liquid suspension contact (e.g., immersion, roll coating, spraying). As depicted in FIG. 2, in some embodiments, the coating station 30 may deposit particles on the tow 25 by contacting the fibers with a liquid suspension. In this regard, the coating station 30 may include a vessel 31 that includes a liquid suspension or dispersion 32 that includes one or more liquids and a plurality of particles dispersed therein. The coating station 30 may be configured such that dispersion 32 contacts (e.g., via immersion, roll coating, spraying or the like) the tow 25 as it is transported though the coating station 30. For example, as shown in FIG. 2, the coating station 30 may include one or more rollers 33 disposed relative to the vessel 31 such that it is at least partially immersed in the dispersion 32, and the tow 25 passes over it at it is transported through the coating station 30. In one embodiment, the vessel 31 may be in fluid communication with a dispersion reservoir [not shown] for replenishing the dispersion 32 as it is applied to the fibers 25. While the coating station 30 is depicted as including only a single vessel 31 and roller 33, it is to be appreciated that any number of additional vessels 31 and/or rollers 33 may be employed.

In various embodiments, the dispersion 32 may include one or more liquids and a plurality of particles dispersed therein. In some embodiments, the one or more liquids may include any or all of water, one or more sizing agents, and one or more surfactants. Suitable sizing agents may include, for example, polyethylene glycol. Suitable surfactants may include, for example, those commercially available as Solplus K500, Solperse 41090, Solplus D540, and Darvan-C. In some embodiments, the dispersion 90 may include 50 wt % to 98 wt % water, 1 wt % to 5 wt % sizing agent, and 0.05 wt % to 0.5 wt % surfactant, based on the total weight of the liquids in the dispersion As set forth above, suitable particles for use in the dispersion 32 may include silica, titania, alumina, zirconia, vanadia, chromia, antimony oxide, tin oxide, zinc oxide, ceria, and mixtures thereof. The particles may range in size from 10 nm-5000 nm, 20 nm-500 nm, 20 nm-100 nm, or 20 nm-50 nm. The quantity of particles in the dispersion 32, which may be referred to herein as the dispersion particle loading, may be at least 0.05%, at least 0.1%, at least 0.5%, or even at least 2% based on the total weight of the liquids in the dispersion.

Generally, the amount of particles deposited on the external surface of the fibers of the tow 25 may be controlled, at least in part, by controlling any or all of (i) the dispersion particle loading; (ii) the rate the tow 25 is transported through the coating station 30; (iii) the number of deposition operations (e.g., passes through a dispersion applicator such as a coating station 30); and (iv) the rate the dispersion is applied to the fiber (e.g., if deposited by spraying, the rate of the spray). In this manner, utilizing the methods of the present disclosure, the particles may be deposited onto the external surface of the fibers such that the particle loading in a resulting composite wire is less than 1%, less than 0.5%, less than 0.1%, or even less than 0.05% based on the total weight of the dry fiber that comprises the tow 25.

In illustrative embodiments, the dryer 40 may include any drying device suitable for removing any water (or at least a portion of any water) of the dispersion 32 that remains on the particle-coated tow 25' after passing through the coating station 30.

In various embodiments, following transport through the dryer 40, a winder 45 may wind the particle-coated tow 25' onto one or more spools, such as one or more supply spools 50, for further processing. Alternatively, the tow 25' may be transported from the dryer 40 directly to a first unit operation of the matrix infiltration process 20.

Moving now to the matrix infiltration process 20, in some embodiments, one or more particle-coated tows 25' may be supplied from supply spools 50, and be collimated into a circular bundle and heat-cleaned while passing through a furnace 55. The tows 25' may then be evacuated in a vacuum chamber 60 before entering crucible 65 containing a matrix melt material 70 (e.g., a melt of metallic matrix material, or a "molten metal") to form a composite wire 75. The tows 25' may be pulled from supply spools 50 by a caterpuller 80. An ultrasonic probe 85 may be positioned in the matrix melt material 70 in the vicinity of the tows 25' to aid in infiltrating the matrix melt material 70 into the tows 25'. The matrix melt material 70 of the composite wire 75 may then cool and solidify after exiting the crucible 65 through an exit die 90, although some cooling may occur before it fully exits the crucible 65. Cooling of the composite wire 75 may be optionally enhanced by a stream of gas or liquid 95. The composite wire 75 may then be collected onto a spool 105. While FIG. 2 depicts one embodiment of a matrix infiltration process 20 it is to be appreciated that any other known metal matrix infiltration processes or steps may be employed without deviating from the scope of the present disclosure.

Generally, heat-cleaning of the tows 25' in the furnace 55 may aid in removing or reducing the amount of sizing, surfactant, adsorbed water, and/or other fugitive or volatile materials that may be present on the surface of the fibers of the tows 25'. Typically, the temperature of the tube furnace is at least 300° C., more typically, at least 1000° C., and the residence time is at least several seconds, although the particular temperature and residence times will depend, for example, on the cleaning needs of the particular fiber being used.

In various embodiments, the tows 25' are evacuated before entering the matrix melt material 70 to reduce or eliminate the formation of defects such as localized regions with dry fibers. The tows 25' may be evacuated in a vacuum of not greater than 20 Torr, not greater than 10 Torr, not greater than 1 Torr, or even not greater than 0.7 Torr. An example of a suitable vacuum system is an entrance tube sized to match the diameter of the tows 25'. A suitable vacuum chamber may include a diameter in the range from 2 cm to about 20 cm, and a length in the range from about 5 cm to 100 cm. The capacity of the vacuum pump may be at least 0.2-0.4 cubic meters/minute. The evacuated tows 25' may be inserted into the matrix melt material 70 through a tube on the vacuum system that penetrates the crucible 65 (i.e., the evacuated tows 25' are under vacuum when introduced into the melt material 70), although the matrix melt material 70 may be at substantially atmospheric pressure. The inside diameter of the exit tube may match the diameter of the tows 25'. A portion of the exit tube may be immersed in the matrix melt material 70. Examples of tubes which are suitable include silicon nitride and alumina tubes.

In illustrative embodiments, infiltration of the matrix melt material 70 into the fibers of the tows 25' may be enhanced by the use of ultrasonics. For example, an ultrasonic probe 85 (e.g., a vibrating horn) may be positioned in the matrix melt material 70 such that it is in close proximity to the tows 25'. The tows 25' may be within 2.5 mm of the horn tip, or within 1.5 mm of the horn tip. The horn tip may be made of niobium, or alloys of niobium, such as 95 wt. % Nb-5 wt. % Mo and 91 wt. % Nb-9 wt. % Mo, and can be obtained, for example, from PMTI, Pittsburgh, Pa. For additional details regarding the use of ultrasonics for making metal matrix composites, see, for example, U.S. Pat. No. 4,649,060 (Ishikawa et al.), U.S. Pat. No. 4,779,563 (Ishikawa et al.), U.S. Pat. No. 4,877,643 (Ishikawa et al.), U.S. Pat. No. 6,245,425, and PCT International Pub. No. WO 97/00976.

In various embodiments, the matrix melt material 70 may be degassed (i.e., the amount of gas (e.g., hydrogen) dissolved in the molten metal may be reduced) during and/or prior to infiltration. Techniques for degassing molten metal are well known in the metal processing art. In embodiments in which the matrix melt material 70 is molten aluminum, the hydrogen concentration of the melt may be less than 0.2, 0.15, or even less than 0.1 $cm^3$/100 grams of aluminum.

In some embodiments, the exit die 90 may be configured to provide a desired composite wire diameter. Typically, it is desired to have a uniformly round wire along its length. The diameter of the exit die 90 may be slightly larger than the diameter of the composite wire 75. For example, the diameter of a silicon nitride exit die for an aluminum composite wire containing 50 volume percent alumina fibers may be 3 percent smaller than the diameter of the composite wire 75. The exit die 90 may be made of silicon nitride, although other materials such as alumina may also be useful.

As discussed above, incorporation of particles into the composite wire manufacturing process, while increasing the strength of the resulting wire, increases the frequency and severity of die plugs that occur in the exit die 90. As also discussed, the composite wire compositions of the present disclosure, which include ultra-low loadings of nanoparticles, exhibit tensile strengths equivalent to that of conventional particle loaded composite wires compositions, but contrary to such conventional compositions, do not contribute to an appreciable increase in the occurrence of costly die plugs during the manufacture process.

In various embodiments, the composite wire 75 may be cooled after exiting the exit die 90 by contacting the composite wire 75 with a liquid (e.g., water) or gas (e.g., nitrogen, argon, or air). Such cooling may aid in providing desirable roundness and uniformity characteristics.

In illustrative embodiments, the diameter of the resulting composite wire 75 may not be a perfect circle. The ratio of the minimum and maximum diameter (i.e., for a given point on the length of the wire, the ratio of the shortest diameter to the largest diameter, wherein for a perfect circle it would be 1) may be at least 0.90, at least 0.91, at least 0.92, at least 0.93, at least 0.94, or even at least 0.95. The cross-sectional shape of the wire in a direction substantially normal to the center longitudinal axis may be, for example, circular, elliptical, square, rectangular, trapezoidal, or triangular. In certain embodiments, each of the composite wires 75 has a cross-sectional shape that is generally circular, and the diameter of each composite wire 75 is at least 0.1 mm, at least 0.5 mm; at least 1 mm, at least 2 mm, at least 3 mm; at least 10 mm, or at least 15 mm. In other embodiments, the diameter of each composite wire 75 may be less than 1 mm, or greater than 5 mm.

In some embodiments, the present disclosure describes a composite cable comprising at least one composite wire as described above. In some embodiments, the cable is a stranded cable comprising a core wire defining a center longitudinal axis, a first plurality of wires stranded around the core, and optionally a second plurality of wires stranded around the first plurality of wires. In certain embodiments, the cable comprises a core comprised of at least one composite wire as described above.

In illustrative embodiments, at least one of the core wire, the first plurality of wires, or the second plurality of wires comprises at least one composite wire as described above. In some embodiments, the core wire is a composite wire as described above. In further embodiments, each of the core wire, the first plurality of wires, and the second plurality of wires is selected to be a composite wire as described above. In additional embodiments, each of the plurality of wires in the cable is a composite wire as described above.

In some embodiments, the disclosure describes a helically stranded composite cable comprising at least one composite wire as described above, the stranded cable comprising a core wire defining a center longitudinal axis, a first plurality of wires helically stranded around the core wire in a first lay direction at a first lay angle defined relative to the center longitudinal axis and having a first lay length, and a second plurality of wires helically stranded around the first plurality of wires in a second lay direction at a second lay angle defined relative to the center longitudinal axis and having a second lay length.

Figure 3:
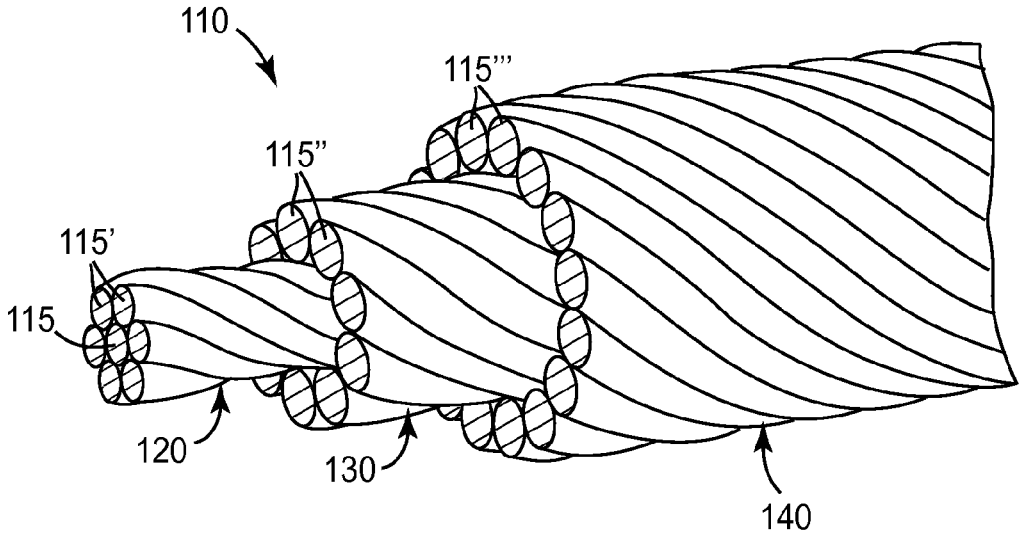
FIG. 3 is a perspective view of a cable incorporating composite wires according to some embodiments of the present disclosure.

Referring again to the drawings, FIG. 3 illustrates a perspective view of a stranded (which may be helically stranded as shown) cable 110 comprising at least one composite wire as described above according to an exemplary embodiments of the present disclosure. As illustrated, the stranded cable may include a core comprising a single filament core wire 115 (which may, for example, comprise a composite wire as described above or a ductile metal wire) defining a center longitudinal axis, a first layer 120 comprising a first plurality of wires 115' (which may, for example, comprise one or more composite wire as described above and/or or one or more ductile metal wires) stranded around the core wire 115 in a first lay direction (clockwise is shown, corresponding to a right hand lay), and a second layer 130 comprising a second plurality of wires 115" (which may, for example, comprise one or more composite wire as described above and/or one or more ductile metal wires) stranded around the first plurality of wires 120 in the first lay direction.

As illustrated further by FIG. 3, optionally, a third layer 140 comprising a third plurality of wires 115''' (which may, for example, comprise one or more composite wire as described above and/or or one or more ductile metal wires) may be stranded around the second plurality of wires 115" in the first lay direction to form composite cable 110. In other embodiments, an optional fourth layer (not shown) or even more additional layers of wires (not shown in the drawings, but which may, for example, comprise one or more composite wire as described above and/or one or more ductile metal wires) may be stranded around the third plurality of wires 115''' in the first lay direction.

In certain embodiments, all of the wires (115, 115', 115", 115"; which may, for example, comprise one or more composite wires as described above and/or or one or more ductile metal wires) in the first (120), second (130), third (140), fourth or higher layers may be selected to be the same or different within each layer and/or between adjacent layers.

In additional illustrative embodiments, two or more stranded layers (e.g., 120, 130, 140, and the like) of composite wires (e.g., 115', 115", 115''', and the like) may be stranded (in some embodiments helically stranded) about the single center composite wire 115 defining a center longitudinal axis, such that each successive layer of composite wires is wound in the same lay direction as each preceding layer of composite wires. Furthermore, it will be understood that while a right hand lay is illustrated in FIG. 1B for each layer (120, 130, and 140), a left hand lay may alternatively be used for each layer (120, 130, 140, and the like).

In any of the foregoing embodiments, the relative difference between the first lay angle and the second lay angle may be greater than 0° and no greater than 4°, the relative difference between the third lay angle and the second lay angle may be greater than 0° and no greater than 4°, the relative difference between the fourth lay angle and the third lay angle may be greater than 0° and no greater than 4°, and in general, any inner layer lay angle and the adjacent outer layer lay angle, may be greater than 0° and no greater than 4°, no greater than 3°, or even no greater than 0.5°.

In further embodiments, the first lay length may be less than or equal to the second lay length, the second lay length may be less than or equal to the third lay length, the fourth lay length may be less than or equal to an immediately subsequent lay length, and/or each succeeding lay length may be less than or equal to the immediately preceding lay length. In other embodiments, the first lay length may equal the second lay length, the second lay length may equal the third lay length, and the third lay length may equal the fourth lay length. In some embodiments, a parallel lay, as is known in the art, may be employed.

In any of the helically stranded composite cable embodiments, the first lay direction may be the same as the second lay direction, the third lay direction may be the same as the second lay direction, the fourth lay direction may the same as the third lay direction, and in general, any outer layer lay direction may be the same as the adjacent inner layer lay direction. However, in other embodiments, the first lay direction may be opposite the second lay direction, the third lay direction may be opposite the second lay direction, the fourth lay direction may be opposite the third lay direction, and in general, any outer layer lay direction may be opposite the adjacent inner layer lay direction.

In illustrative embodiments, the stranded composite cables of the present disclosure may be long. Additionally, the composite wires within the stranded composite cable themselves may be continuous throughout the length of the stranded cable. In one embodiment, the composite wires may be substantially continuous and at least 150 meters long. Alternatively, the composite wires may be continuous and at least 250 meters long, at least 500 meters, at least 750 meters, or even at least 1000 meters long in the stranded composite cable.

Figure 4:
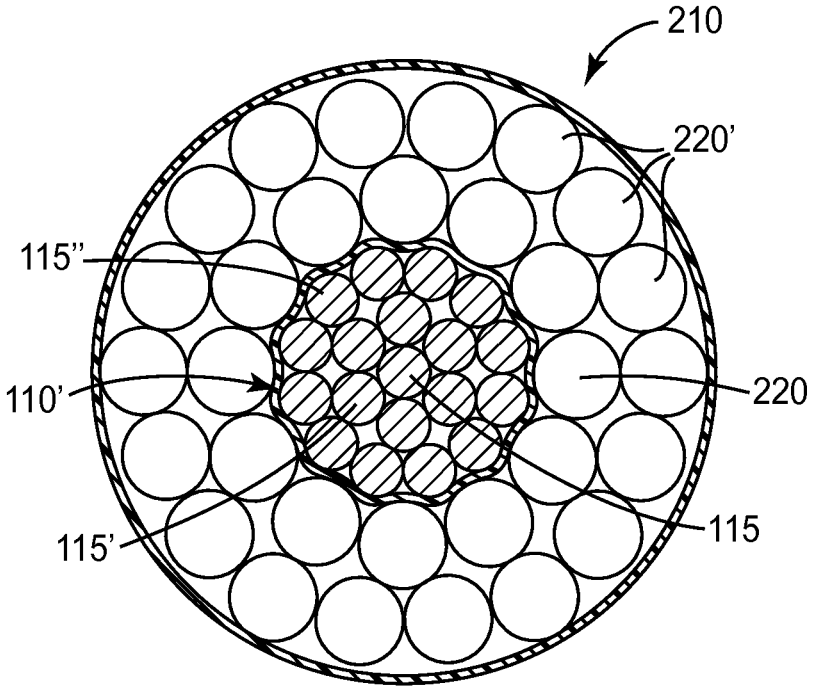
FIG. 4 is a cross-sectional end view of a cable incorporating composite wires and optional ductile metal wires according to some embodiments of the present disclosure.

Returning again to the drawings, in some embodiments, a composite stranded cable as described above may be used advantageously as a core cable in constructing a larger diameter cable, for example, a power transmission cable. As illustrated by FIG. 4, a stranded power transmission cable 210 may comprise a first plurality of ductile metal wires 220 stranded around a plurality of composite wires (115, 115', 115"), the plurality of composite wires (115, 115', 115") forming a composite wire core 110' for the power transmission cable 210. A second plurality of ductile metal wires 220' may be stranded around the first plurality of ductile metal wires 220.

Suitable ductile metal wires for use in the cables of the present disclosure include wires made of iron, steel, zirconium, copper, tin, cadmium, aluminum, manganese, and zinc; their alloys with other metals and/or silicon; and the like. Copper wires are commercially available, for example from Southwire Company, Carrolton, Ga. Aluminum wires are commercially available, for example from Nexans, Weyburn, Canada or Southwire Company, Carrolton, Ga. under the trade designations "1350-H19 ALUMINUM" and "1350-H0 ALUMINUM".

In additional embodiments, the disclosure provides a method of making the stranded composite cables as described in any of the foregoing embodiments, the method comprising stranding a first plurality of wires about a core (e.g., a composite wire) defining a center longitudinal axis, wherein helically stranding the first plurality of composite wires is carried out in a first lay direction at a first lay angle defined relative to the center longitudinal axis, wherein the first plurality of wires have a first lay length; helically stranding a second plurality of composite wires around the first plurality of composite wires, wherein helically stranding the second plurality of composite wires is carried out in the first lay direction at a second lay angle defined relative to the center longitudinal axis, and wherein the second plurality of wires has a second lay length. In one embodiment, the helically stranded composite cable includes a plurality of composite wires that are helically stranded in a lay direction to have a lay factor of from 6 to 150. The "lay factor" of a stranded cable is determined by dividing the length of the stranded cable in which a wire completes one helical revolution by the nominal outside of diameter of the layer that includes that strand. While any suitably-sized composite wires can be used, in some embodiments the composite wires have a diameter from 1 mm to 4 mm, however larger or smaller composite wires can be used.

In some embodiments, the disclosure describes a method of making a helically stranded cable including a plurality of the composite wires described above. The method may comprise helically stranding a first plurality of wires about a core wire defining a center longitudinal axis, wherein helical stranding of the first plurality of wires is carried out in a first lay direction at a first lay angle defined relative to the center longitudinal axis; helically stranding a second plurality of wires around the first plurality of wires, wherein helical stranding of the second plurality of wires is carried out in the first lay direction at a second lay angle defined relative to the center longitudinal axis. At least one of the core wire, the first plurality of wires, and the second plurality of wires may be selected to be a composite wire as described above.

Optionally, the helically stranded first and second plurality of wires may be heated to a temperature sufficient to retain the helically stranded wires in a helically stranded configuration upon cooling to 25° C. Optionally, the first and second pluralities of wires may be surrounded with a corrosion resistant sheath and/or an armor element.

In other embodiments of a method of making a helically stranded composite cable, the relative difference between the first lay angle and the second lay angle is greater than 0° and no greater than 4°. In certain embodiments, the method further comprises stranding a plurality of ductile metal wires around the core wire defining the center longitudinal axis.

The wires may be stranded or helically wound as is known in the art on any suitable cable stranding equipment, such as planetary cable stranders available from Cortinovis, Spa, of Bergamo, Italy, and from Watson Machinery International, of Patterson, N.J. In some embodiments, it may be advantageous to employ a rigid strander, or a capstan to achieve a core tension greater than 100 kg, as is known in the art. Exemplary stranding processes and apparatus are described, for example, in U.S. Pat. Nos. 5,126,167 and 7,093,415. During the cable stranding process, the core wire, or the intermediate unfinished stranded composite cable which will have one or more additional layers wound about it, may be pulled through the center of the various carriages, with each carriage adding one layer to the stranded cable. The individual wires to be added as one layer may be simultaneously pulled from their respective bobbins while being rotated about the center axis of the cable by the motor driven carriage. This may be done in sequence for each desired layer. The result is a helically stranded composite core.

In some embodiments, it may be desirable to provide the core wire at an elevated temperature (e.g., at least 25° C., 50° C., 75° C., 100° C., 125° C., 150° C., 200° C., 250° C., 300° C., 400° C., or even, in some embodiments, at least 500° C.) above ambient temperature (e.g., 22° C.). The core wire can be brought to the desired temperature, for example, by heating spooled wire (e.g., in an oven for several hours). The heated spooled wire may be placed on the pay-off spool of a stranding machine.

In further embodiments, it may be desirable to provide all of the wires at an elevated temperature (e.g., at least 25° C., 50° C., 75° C., 100° C., 125° C., 150° C., 200° C., 250° C., 300° C., 400° C., or even, in some embodiments, at least 500° C.) above ambient temperature (e.g., 22° C.). The wires can be brought to the desired temperature, for example, by heating spooled wire (e.g., in an oven for several hours). The heated spooled wire may be placed on the pay-off spool and bobbins of a stranding machine.

In certain embodiments, it may be desirable to have a temperature differential between the core wire and the other wires which form the outer layers during the stranding process. In further embodiments, it may be desirable to conduct the stranding with a core wire tension of at least 100 kg, 200 kg, 500 kg, 1000 kg., or even at least 5000 kg.

Helically stranded composite cables of the present disclosure are useful in numerous applications. Such cables are believed to be particularly desirable for use as electrical power transmission cables, which may include overhead, underground, and underwater electrical power transmission cables, due to their combination of low weight, high strength, good electrical conductivity, low coefficient of thermal expansion, high use temperatures, and resistance to corrosion. The helically stranded composite cables may also be used as intermediate articles that are later incorporated into final articles, for example, towing cables, hoist cables, electrical power transmission cables, and the like.

The electrical power transmission cable may include two or more optional layers of ductile metal conductor wires. More layers of ductile metal conductor wires may be used as desired. When used as an electrical power transmission cable, the optional ductile metal wires may act as electrical conductors, i.e., ductile metal wire conductors. Each conductor layer may comprise a plurality of ductile metal conductor wires as is known in the art. Suitable materials for the ductile metal conductor wires include aluminum and aluminum alloys. The ductile metal conductor wires may be stranded about the helically stranded composite core by suitable cable stranding equipment as is known in the art.

The weight percentage of composite wires within the electrical power transmission cable will depend upon the design of the transmission line. In the electrical power transmission cable, the aluminum or aluminum alloy conductor wires may be any of the various materials known in the art of overhead power transmission, including, but not limited to, 1350 Al (ASTM B609-91), 1350-H19 Al (ASTM B230-89), or 6201 T-81 Al (ASTM B399-92).

An application of the electrical power transmission cable is as an overhead electrical power transmission cable, an underground electrical power transmission cable, or an underwater electrical power transmission cable, such as a underwater tether or an underwater umbilical. For a description of suitable overhead electrical power transmission cables, underground electrical power transmission cables, underwater electrical power transmission cables, underwater tethers and underwater umbilicals, see for example, U.S. Patent Application Pub. Nos. 2012/0163758 and 2012/0168199.

For a description of suitable electrical power transmission cables and processes in which the stranded cable of the present disclosure may be used, see, for example, Standard Specification for Concentric Lay Stranded Aluminum Conductors, Coated, Steel Reinforced (ACSR) ASTM B232-92; or U.S. Pat. Nos. 5,171,942 and 5,554,826. In these electrical power transmission applications, the wires used in making the cable should generally be selected for use at temperatures of at least 240° C., 250° C., 260° C., 270° C., or even 280° C., depending on the application.

As discussed above, the electrical power transmission cable (or any of the individual wires used in forming the stranded composite cable) may optionally be surrounded by an insulative layer or sheath. An armor layer or sheath may also be used to surround and protect the electrical power transmission cable (or any of the individual wires used in forming the stranded composite cable).

In some other applications, in which the stranded composite cable is to be used as a final article itself (e.g. as a hoist cable), it may be preferred that the stranded composite cable be free of electrical power conductor layers.

Embodiments

Embodiment 1 is a method for making a composite material, the method comprising:

impregnating a plurality of particle-loaded fibers with a metal matrix; and solidifying the metal matrix;

wherein following solidifying, at least 25% of the fibers contact or are spaced less than 0.2 micrometers from an adjacent fiber within the metal matrix.

Embodiment 2 is the method of Embodiment 1, wherein the particles are present at less than 1 wt. % based upon the total dry weight of the fibers.

Embodiment 3 is a method for making a composite wire, the method comprising:

impregnating a plurality of substantially continuous, particle loaded fibers with a metal matrix, wherein following impregnating, at least 25% of the fibers contact or are spaced less than 0.2 micrometers from an adjacent fiber within the metal matrix pulling the fibers impregnated with the metal matrix through a die; and solidifying the metal matrix, thereby forming a substantially continuous composite wire.

The operation of the present disclosure will be further described with regard to the following detailed examples. These examples are offered to further illustrate the various specific and preferred embodiments and techniques. It should be understood, however, that many variations and modifications may be made while remaining within the scope of the present disclosure.

EXAMPLES

The following illustrative and comparative examples are offered to aid in the understanding of the present invention and are not to be construed as limiting the scope thereof. Unless otherwise indicated, all parts and percentages are by weight. The following test methods and protocols were employed in the evaluation of the illustrative and comparative examples that follow.

Sample Preparation

Preparation of Particle Dispersion

The concentrated aqueous dispersion of particles was prepared as follows. In a premixing step, Solsperse 41090 dispersant (Lubrizol, USA,) was dissolved in water using a Dispermat High Speed Laboratory Dissolver (BYK-Gardner USA, USA.) Agglomerated Gamma Aluminum Oxide Nano Powder (product number 26N-0801G from Inframat, USA, primary average particle size of 40 nm, particle size range of 20-50 nm) was slowly charged into the water/dispersant solution until a concentration of 34% solids was reached. The dispersion was then pumped into a MiniCer media mill (Netzsch Inc., USA) and circulated. Particle size was monitored during milling using a LA-950 Laser Diffraction Particle Size Distribution Analyzer (Horiba Instruments Inc., USA) until a median particle agglomeration size of 0.090 μm was reached.

Sizing solution was prepared by slowly adding 5% by weight (wt %) polyethylene glycol (PEG, Polyglykol 35000, Clariant, Switzerland) to water while mixing. The solution was mixed until clear.

Approximately 6 g of the concentrated particle dispersion was then added to 1000 g of the sizing solution and agitated. The final aqueous particle/sizing dispersion contained 4.97 wt % PEG and 0.2 wt % particles.

Preparation of Particle-Coated Fibers

Alumina particles and sizing material were then deposited on tows of NEXTEL 610 alumina ceramic fibers (3M Company, USA). Each tow contained approximately 5200 fibers. The fibers had kidney bean shaped cross sections with aspect ratios of approximately two, the shortest diameter ranged from 5 to 10 μm, and the longest diameter ranged from 10 to 20 μm.

Deposition of the alumina particles was achieved by a kiss roll coating method in which a tow of NEXTEL 610 fibers was passed through a coating station containing the aqueous particle dispersion. A schematic of this process is provided as feature 10 in FIG. 2. The aqueous particle dispersion described above was placed into the coating tray of the coating station. Coating roll 33 picked up the particle dispersion and deposited it onto the NEXTEL 610 fiber tow. The sizing was coated onto one fiber tow by passing the tow over the sizing roll. The speed of the sizing application roll was adjusted to provide a sizing net coating weight of 1.5 wt %. The coated fiber tow was wrapped around drying cans (15 cm (6 inch) diameter chrome-coated steel rolls heated to 100° C.) twelve times to remove water and then wound onto cardboard cylinders.

The weight fractions of sizing and alumina particles on the particle-coated fiber were determined by drying a four meter section of coated fiber at 110° C. for five minutes to ensure all the water was removed. A first sample weight ($w_{initial}$) was measured. The sample of particle-coated sized tow was then put into a furnace at 750° C. for five minutes to burn off the polymeric sizing material, removed from the furnace, and allowed to cool to room temperature. The sizing material was visually observed to have cleanly burned-off the fibers. A second sample weight ($w_{final}$) was measured. The weight percent sizing applied ($S_w$) was calculated using the following formula:

$$Sw = \frac{(w_{initial} - w_{final})}{w_{initial}} \times 100$$

The particle loading on the fiber was then calculated using the weight ratio of polymeric solids to inorganic particles in the particle/sizing dispersion prepared as described previously.

Preparation of Metal Matrix Composite Wires from Particle-Coated Fibers

To create the particle-loaded aluminum matrix composite wires of the Examples, tows of particle-coated fibers prepared as described above were processed through the line illustrated as feature 20 in FIG. 2. The remaining organic sizing material was first evaporated in a radiant tube furnace at 1200° C., and pressure and infiltration were used to infiltrate molten aluminum in to fiber bundle to make a particle wire. A detailed description of the process and apparatus for preparing metal matrix composite wires can be found in granted U.S. Pat. No. 7,297,238. Particle-loaded aluminum matrix composite wires were prepared using either 3 or 4 tows of particle-coated NEXTEL 610 alumina fibers.

The diameter of the metal matrix composite wire was measured by taking micrometer readings at four points along the wire. Typically the wire cross-section was not perfectly circular, resulting in long and short diameters. The readings were taken by rotating the wire to ensure that both the long and short diameters were measured. The wire diameter was reported as the average of the readings, and a cross-sectional area was calculated from the diameter.

The amount of alumina fiber in each composite wire as a fraction of the total volume of the composite wire was calculated from denier values of the fibers in each tow, the number of tows used to make the wire, the density of the fiber, and the dimensions of the composite wire. First, the denier of a fiber tow was determined by weighing four meters of a tow of uncoated fiber and multiplying by 2250 to yield the weight of fiber in 9000 meters of a single tow. Total denier was calculated by multiplying this figure by the number of tows of fiber used to make the composite wire. Total volume of fiber was calculated by dividing total fiber weight by the density of the alumina fiber, which is known to be 3.88 g/cm$^3$. The wire diameter was measured and wire volume of the four meter segment was calculated. Fiber volume fraction was determined by dividing fiber volume by total wire volume.

Parameters of the illustrative Examples 1-5 are provided in Table 1. The examples contained various amounts of particles and varying volume fractions of fiber.

TABLE 1

| WIRE EXAMPLE | INDIVIDUAL DENIER | NUMBER OF TOWS | TOTAL FIBER DENIER | VOLUME FRACTION OF FIBER | WIRE DIAMETER, IN | PARTICLE COATING WT % |
|---|---|---|---|---|---|---|
| 1 | 20,000 | 3 | 60,000 | 57% | 0.077 | 0.07 |
| 2 | 20,000 | 3 | 60,000 | 57% | 0.077 | 0.03 |
| 3 | 19,000 | 3 | 57,000 | 54% | 0.077 | 0.03 |
| 4 | 16,625 | 4 | 66,500 | 55% | 0.083 | 0.04 |
| 5 | 19,000 | 3 | 57,000 | 54% | 0.077 | 0.03 |

Comparative Examples CE1-CE4

Aluminum matrix composite wire samples for Comparative Examples CE1-CE4 were prepared as described above, except that no alumina particles were included in the sizing solution. Properties of CE1-CE4 are provided in Table 2.

TABLE 2

| WIRE EXAMPLE | INDIVIDUAL DENIER | NUMBER OF TOWS | TOTAL FIBER DENIER | VOLUME FRACTION OF FIBER | WIRE DIAMETER, IN | PARTICLE COATING WT % |
|---|---|---|---|---|---|---|
| CE1 | 20,000 | 3 | 60,000 | 57% | 0.077 | 0 |
| CE2 | 20,000 | 3 | 60,000 | 57% | 0.077 | 0 |
| CE3 | 17,500 | 4 | 70,000 | 57% | 0.083 | 0 |
| CE4 | 20,000 | 3 | 60,000 | 57% | 0.077 | 0 |

Comparative Examples CE5-CE7

Results for Comparative Examples CE5-CE7 were derived from the prior art references listed in Table 3 below. The number of fiber-to-fiber contacts was determined as described later by examining optical micrographs published in each reference. Tensile test results are described in the text of each reference.

TABLE 3

| EXAMPLE | PRIOR ART REFERENCE |
|---|---|
| CE5 | U.S. Pat. No. 4,961,990 and S. Yamada, S. Towata, and H. Ikuno; "Mechanical properties of Aluminum alloys reinforced with continuous fibers and dispersoids," pp 109-114 of *Cast Re-inforced Metal Composites*, S. G. Fishman and A. K. Dhinsara, ed., (1992). |
| CE6 | M. S. Hu, J. Yang, H. C. Cao, A. G. Evans, and R. Mehrabian; "The mechanical properties of Al alloys reinforced with continuous $Al_2O_3$ fibers," *Acta Metallurgica et Materiala*, Vol 40, No. 9, pp 2315-2326 (1992). |
| CE7 | H. K. Asano, "Effects of Particle-Dispersion on the Tensile Properties of Continuous Alumina Fibers," *Journal of the Jap. Inst. Of Metals,* Vol 68, pp. 582-590 (2004). |

The aluminum alloy metal matrix composites of CE5 were manufactured by squeeze casting Si—Ti—C—O fibers at a casting pressure of 90 MPa and time of 60 secs. Prior to squeeze casting the aluminum metal matrix, whiskers and particulates were mixed with sizing and alcohol to apply on the top of fibers and later drying them. In the CE6 reference, aluminum matrix composites were uni-directionally reinforced with Al2O3 fibers. CE7 utilized squeeze casting to make metal matrix composites with 40 to 60% fiber loading and 0 to 10% particle alumina particles of 1 micron in size.

Test Methods

Composite Wire Tensile Strength

Tensile properties of the metal matrix composite wires prepared from both particle-coated fibers and uncoated fibers were determined essentially as described in ASTM D3552-96, Standard Test Method for Tensile Properties of Fiber Reinforced Metal Matrix Composites using a Universal Tensile Tester and a strain rate of 0.01%/sec. Output from the tensile test provided load to failure, tensile strength, tensile modulus, and strain to failure data for the samples. Five wire specimens having a gage length of greater than 1 foot (31.5 cm) were tested, from which average, standard deviation, and coefficient of variation could be calculated.

Degree of Fiber-to-Fiber Contact

Fiber spacing within the metal matrix composites and wires was gauged by analyzing SEM micrographs or optical images of the composite and counting the number of contacts between fibers within the image. If the image was too small for a statistically significant analysis, a magnification of the image was used in order to detect the fiber-to-fiber contacts within the resolution of the unaided human eye. Approximately 40-50 fibers within each image were examined. For each fiber, the number of neighboring fibers in direct contact with it was counted. Fibers that are in "contact" are defined herein as fibers that touch or are spaced less than 0.2 μm away from at least one adjacent fiber. Percentages of fibers with at least one fiber-to-fiber contact and with no fiber-to-fiber contacts were calculated. To determine the effect of the addition of particles to the composite, results for composites comprising particles were compared to those for composites that were virtually identical, except did not contain particles.

Results

Tensile Strength

Tensile strength of Examples 1-5 and Comparative Examples CE1-CE4 are provided in Table 4. A comparison of the results for Example 1 and CE1 demonstrates that addition of particles to the aluminum matrix composite wire at a loading of 0.07 wt % results in an increase in tensile strength of 8.3% when the same amount of fiber is used in the wire. Tensile strength values for Example 2 and CE2 demonstrate that addition of particles to the aluminum matrix composite wire at a loading of 0.03 wt % results in an increase in tensile strength of 2.5% when the same amount of fiber is used in the wire. A comparison of the results for Example 3 and CE2 demonstrates that addition of particles to the aluminum matrix composite wire at a loading of 0.03 wt % results in an increase in tensile strength of 1.1%, even when the amount of fiber used in the wire is reduced by 5%. A comparison of the results for Example 4 and CE3 demonstrates that addition of particles to the aluminum matrix composite wire at a loading of 0.04 wt % results in an increase in tensile strength of 1.1%, even when the amount of fiber used in the wire is reduced by 5%. A comparison of the results for Example 5 and CE4 demonstrates that addition of particles to the aluminum matrix composite wire at a loading of 0.03 wt % results in an increase in tensile strength of 0.3%, even when the amount of fiber used in the wire is reduced by 5%.

TABLE 4

| WIRE EXAMPLE | TOTAL FIBER DENIER | WIRE DIAMETER, IN | PARTICLE COATING, WT % | TENSILE STRENGTH, LBF (MPa) | INCREASE IN TENSILE STRENGTH OVER COMPARATIVE EXAMPLE |
|---|---|---|---|---|---|
| 1 | 60,000 | 0.077 | 0.07 | 1116 (1652) | 8.3% |
| 2 | 60,000 | 0.077 | 0.03 | 1008 (1492) | 2.5% |
| 3 | 57,000 | 0.077 | 0.03 | 994 (1472) | 1.1% |
| 4 | 66,500 | 0.083 | 0.04 | 1152 (1504) | 1.6% |
| 5 | 57,000 | 0.077 | 0.03 | 977 (1447) | 0.3% |
| CE1 | 60,000 | 0.077 | 0 | 1030 (1525) | — |
| CE2 | 60,000 | 0.077 | 0 | 983 (1455) | — |
| CE3 | 70,000 | 0.083 | 0 | 1133 (1479) | — |
| CE4 | 60,000 | 0.077 | 0 | 999 (1479) | — |

Degree of Fiber-to-Fiber Contact

Results of image analysis for degree of fiber contact for Example 4 and Comparative Examples CE3 and CE5-CE7 are provided in Table 5. In Example 4, 90% of the fibers were spaced less than 0.2 μm from at least one adjacent fiber. None of the fibers observed in the CE5 and CE6 composites that contained particles appeared to be spaced less than 0.2 μm from at least one adjacent fiber, and a very low percentage of the fibers observed in the CE7 containing particles appeared to be spaced less than 0.2 μm from at least one adjacent fiber. In all of the Comparative Examples that did not contain particles, a large percentage of the fibers were spaced less than 0.2 μm from at least one adjacent fiber.

TABLE 5

| | WITH PARTICULATES | | NO PARTICULATES | |
|---|---|---|---|---|
| EXAMPLE | % OF FIBERS WITH ≥ 1 CONTACT | % OF FIBERS WITH NO CONTACTS | % OF FIBERS WITH ≥ 1 CONTACT | % OF FIBERS WITH NO CONTACTS |
| 4 | 90 | 10 | | |
| CE3 | | | 95 | 5 |
| CE5 | 0 | 100 | 80 | 20 |
| CE6 | 0 | 100 | 91 | 9 |
| CE7 | 23 | 77 | 92 | 8 |

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. This application is intended to cover any adaptations or variations of the preferred embodiments discussed herein. Therefore, it is manifestly intended that this invention be limited only by the claims and the equivalents thereof.

Furthermore, all publications and patents referenced herein are incorporated by reference in their entirety to the same extent as if each individual publication or patent was specifically and individually indicated to be incorporated by reference. Various exemplary embodiments have been described. These and other embodiments are within the scope of the following claims.

The invention claimed is:

1. A composite material comprising:

a plurality of fibers embedded in a metal matrix; and a plurality of particles disposed in the metal matrix;

wherein at least 25% of the fibers contact or are spaced less than 0.2 micrometers from an adjacent fiber within the metal matrix.

2. The composite material of claim 1, wherein at least 50% of the fibers contact or are spaced less than 0.2 micrometers from an adjacent fiber within the metal matrix.

3. The composite material of claim 1, wherein the composite material is in the form of a wire.

4. The composite material of claim 3, wherein the fibers comprise substantially continuous fibers.

5. The composite material of claim 1, wherein the plurality of particles are present at less than 1 wt. % based upon the total dry weight of the fibers.

6. The composite material of claim 1, wherein the plurality of particles are present at less than 0.1 wt. % based upon the total dry weight of the fibers.

7. The composite material of claim 5, wherein the plurality of particles have a mean diameter of no greater than 300 nanometers.

8. The composite material of any one of claim 5, wherein the composite material does not comprise any or all of whiskers, short fibers, or chopped fibers.

9. A composite wire comprising:

a plurality of substantially continuous fibers embedded in a metal matrix, the plurality of substantially continuous fibers and metal matrix forming a substantially continuous composite wire; and a plurality of particles disposed in the metal matrix;

wherein the plurality of particles are present at less than 0.1 wt. % based upon the total dry fiber weight of the substantially continuous fibers; and wherein the plurality of particles have a mean diameter of no greater than 100 nanometers.

10. A cable comprising at least one composite wire of claim 9.

11. A stranded cable comprising at least one composite wire of 9, wherein the stranded cable comprises:

a core wire defining a center longitudinal axis;

a first plurality of wires stranded around the core wire; and a second plurality of wires stranded around the first plurality of wires.

12. A helically stranded cable including at least one composite wire of claim 9, wherein the helically stranded cable is comprised of:

a core wire defining a center longitudinal axis;

a first plurality of wires helically stranded around the core wire in a first lay direction at a first lay angle defined relative to the center longitudinal axis and having a first lay length; and a second plurality of wires helically stranded around the first plurality of wires in a second lay direction at a second lay angle defined relative to the center longitudinal axis and having a second lay length.

13. The stranded cable of claim 12, wherein the core wire comprises at least one composite material of claim 9.

14. The stranded cable of any one of claim 12, wherein each of the first plurality of wires comprises at least one composite wire of claim 9.

15. The stranded cable of claim 14, wherein each of the second plurality of wires comprises at least one composite wire of claim 9.

16. The stranded cable of claim 15, wherein each wire has a cross-section in a direction substantially normal to the center longitudinal axis, and wherein the cross-sectional shape of each wire is selected from the group including circular, elliptical, and trapezoidal.

17. The stranded cable of claim 16, wherein the cross-sectional shape of each wire is circular, and wherein the diameter of each wire is from 1 mm to 2.5 cm.

18. The stranded cable of claim 17, wherein each of the first plurality of wires and the second plurality of wires has a lay factor of from 10 to 150.

19. The stranded cable of 18, wherein the first lay direction is the same as the second lay direction.

20. The stranded cable of claim 19, wherein a relative difference between the first lay angle and the second lay angle is greater than 0° and no greater than 4°.

* * * * *